US005583311A

United States Patent [19]

Rieger

[11] Patent Number: 5,583,311

[45] Date of Patent: Dec. 10, 1996

[54] INTERCEPT DEVICE FOR FLYING OBJECTS

[75] Inventor: Ulrich Rieger, Feldkirchen-Westerham, Germany

[73] Assignee: Daimler-Benz Aerospace AG, München, Germany

[21] Appl. No.: 407,107

[22] Filed: Mar. 17, 1995

[30] Foreign Application Priority Data

Mar. 18, 1994 [DE] Germany ..... 44 09 424.8

[51] Int. Cl.[6] ..... F42B 15/00; F42B 12/68

[52] U.S. Cl. ..... 89/1.11; 89/1.34; 102/405; 102/504; 244/110 F

[58] Field of Search ..... 89/1.11, 1.34; 102/404, 405, 504; 244/110 C, 110 F

[56] References Cited

U.S. PATENT DOCUMENTS

| | | | |
|---|---|---|---|
| 2,251,918 | 8/1941 | Dawson | 102/504 |
| 2,354,754 | 8/1944 | Irwin | 102/405 |
| 2,363,626 | 11/1944 | Uzmann | 102/405 |
| 2,365,778 | 12/1944 | Schwab . | |
| 2,374,261 | 4/1945 | Ames | 89/1.11 |
| 3,667,387 | 6/1972 | Picard et al. | 102/426 |

FOREIGN PATENT DOCUMENTS

| | | | |
|---|---|---|---|
| 0175914 | 4/1986 | European Pat. Off. . | |
| 833633 | 10/1938 | France | 102/405 |
| 859282 | 12/1940 | France . | |
| 863884 | 4/1941 | France . | |
| 2415288 | 10/1975 | Germany . | |
| 0175914 | 8/1985 | Germany . | |
| 3722420A1 | 1/1989 | Germany . | |
| 514370 | 2/1938 | United Kingdom | 102/405 |
| 529623 | 11/1940 | United Kingdom | 89/1.11 |
| 538395 | 8/1941 | United Kingdom | 102/405 |

*Primary Examiner*—Michael J. Carone
*Assistant Examiner*—Theresa M. Wesson
*Attorney, Agent, or Firm*—McGlew and Tuttle

[57] ABSTRACT

An intercept device for flying objects is formed of a lightweight, small-volume, packable structure made of a tear-resistant, pliable material, which can be stretched to a large, two-dimensional or three-dimensional expansion by means of a deployment device. To reduce the velocity of the intercepted flying objects, activatable, aerodynamic resistance bodies are incorporated into the structure. To end the intercept procedure, elements are integrated into the structure, which consist of material that can be destroyed from outside by means of high-energy beams and/or chemical reagents, or that destroys itself, or the structure as a whole consists of such material.

20 Claims, 1 Drawing Sheet

INTERCEPT DEVICE FOR FLYING OBJECTS

FIELD OF THE INVENTION

The present invention pertains to an intercept device for flying objects, particularly for manned aircraft, including a light weight, small volume, packable structure made of a tear-resistant-pliable material, which can be stretched to a large two dimensional or three dimensional expanded structure by means of a deployment device.

BACKGROUND OF THE INVENTION

The interception of enemy aircraft and helicopters, which are flying near the ground, by means of cables, cable fans, nets, etc., whereby the intercept means are brought into the expected flight path from the ground, e.g., by means of small solid fuel rockets, is known. Steel cables or two-dimensional formed bodies made of steel cable are preferably used, since they are not easily cut through due to their high strength and hardness and their high specific weight, and they exert a highly destructive action. In this method of interception, the aircraft are destroyed, as a rule, and the crew is killed, which is consciously accepted or even intended in the case of war.

Thus, French Patent No. FR-PS 859,282, which comes closest to the object of the of the present invention, describes intercept devices in the form of net-like structures, which are brought into the flight path of the object to be fought by means of a carrier projectile and are deployed there preferably by means of centrifugal force. For this purpose, small, uniformly distributed centrifugal weights are arranged on the net. The vertical rate of fall of the intercept device can be slowed down, for example, by means of several, small parachutes, i.e., by means of aerodynamic resistance bodies, by means of which a longer residence time in the air and thus a higher probability of hitting are achieved. In this case, the application possibilities should also apply to land vehicles and watercraft.

EP-OS 0,175,914 describes comparable intercept devices, in which at least one projectile is moved in the direction of the object to be fought, and a parachute-like, tennis-net-like, piano-accordion-like or octahedron-like element is discharged from the projectile near the object and is deployed in a large area. The air or water resistance associated with the size and the shape of the element is used to support the deployment in this case. Between the projectile/projectiles and the element are provided shock-absorbing means to prevent damage to the element or its separation from the projectile during deployment.

German Offenlegungsschrift No. DE-OS 24 15 288 describes air and water obstacles in the form of arrester cables launched with rockets. In the case of air obstacles, the cables are prevented from dropping too rapidly by means of parachutes, balloons, wings, etc.

German Patent No. DE-PS 37 22 420 deals with intercept devices in the form of cords or cables for fighting helicopters, which devices are deployed in a bundle-like or net-like manner and should collide with the main rotor or control rotor of the helicopter. In this case, the goal is clearly to destroy the helicopter by crashing.

However, there are now also military or political situations of crisis and tension, in which one would like to prevent enemy flying objects from carrying out missions or to at least destroy them, in which, however, deliberate destruction or shooting down could unnecessarily intensify the situation or could even lead to an escalation up to the outbreak of war. A typical example of this are flight bans in crisis regions, the observance of which, e.g., by UN peace-keeping forces, is practically hardly enforceable without the use of deadly weapons, if enemy aircraft are already in the air.

SUMMARY AND OBJECTS OF THE INVENTION

In view of this problem, the object of the present invention is to create an intercept device for flying objects, especially manned aircraft, which is capable of effectively hindering or stopping enemy or unauthorized flight missions while abstaining from destructive or deadly means.

According to the invention, an intercept device for flying objects is provided, particularly for manned aircraft, including a light weight, small volume, packable structure made of a tear resistant, pliable material. The structure can be stretched to a large two dimensional or three dimensional expanded structure by means of a deployment device. Aerodynamic resistance bodies (such as parachutes or other elements with high drag) are incorporated in the structure. Intercept termination means is provided for ending the intercept procedure. The intercept termination means includes one of forming the elements of the structure of material that can be destroyed by high energy beams and/or chemical reagents or incorporating chemical reagents into the material of the structure.

The structure is preferably netlike such as a cobweb-like structure, a balloon-like structure with a plurality of perforations, a hedge-hog like structure or even a dandelion-seed-like structure with a plurality of radial ribbons, hoses and, cables which emanate from a center. The aerodynamic resistance bodies preferably are in the form of balloons that are inflatable by air current, air bags, deployable parachutes and, ribbons that move rapidly at abrupt angles or even formed bodies which can be inflated or filled with foam by means of additional expanding agents. The intercept termination means preferably includes self destruct devices such as chemical reagents which are stored in the structure and can be intentionally released for at least partially dissolving the material of the structure, such as dissolving the structure at key points. Alternatively, the intercept termination means can be pyrotechnic elements positioned to destroy locally portions of the structure. These elements may also be positioned at key points for breaking up the structure to effectively reduce or terminate the intercept procedure. The intercept termination means may also be a self destruct device including fusible wire elements which locally break the structure. A self destruct device with electro mechanical elements which locally break the structure may also be provided.

The essence of the present invention lies in the fact that the intercept device neither seriously damages nor destroys the flying object in question, but has a negative effect on its flying properties, especially on its velocity and its maneuverability, by means of aerodynamic, active bodies, so that the flying object cannot continue its mission as planned. This hindrance or interference is limited with regard to time, in that the intercept device is itself destroyed at a selectable point in time, so that the flying object can again return to its airfield unhindered and land safely. The intercept device must be destroyed at the latest, if dangerous flight conditions, such as too short a distance from the ground or spinning, occur.

Admittedly, the present invention is less suitable or not suitable for intercepting helicopters (gyroplanes) and propeller-driven aircraft, because the risk of the rotor or the propeller being stopped or destroyed would be too great, which would result in an immediate emergency landing or a crash.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
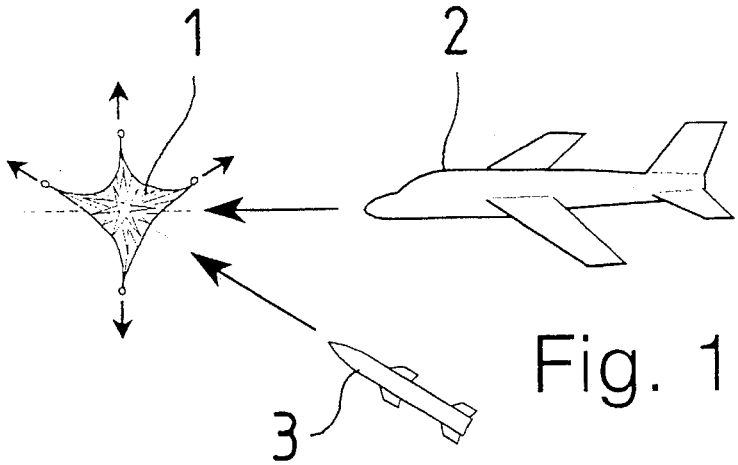
FIG. 1 shows an aircraft approaching an intercept device, which was launched into position by a rocket and is being deployed.

The expected flight path of the aircraft 2 in FIG. 1 is marked with a horizontal arrow as well as—in its extension—with a dotted line. This flight path intersects the flight path of a rocket 3 coming from the right below, which carries the intercept device 1 with it as a payload. At the point of intersection of the flight paths, the intercept device I is released, e.g., by means of the explosive self-destruct of the rocket 3, and deployed. The deployment can also take place or be supported, e.g., by means of additional, small solid fuel rockets or by means of spring-type elements, such as wires, springs, etc. The intercept device can assume both a two-dimensional and a three-dimensional extension, e.g., in the form of a net, a perforated balloon, or a "hedgehog" or "dandelion seed," whereby the extension must be great diagonally to the flight path in all directions so that the aircraft is entangled with certainty. High-performance plastic fibers are suitable as the base material for the structure of the intercept device, since these plastic fibers are light, tear-resistant, elastic and pliable, and thereby reduce the risk of damage to the aircraft to a minimum. In addition, they are, if required, destroyed relatively easily and rapidly by means of heat or chemicals.

Figure 2:
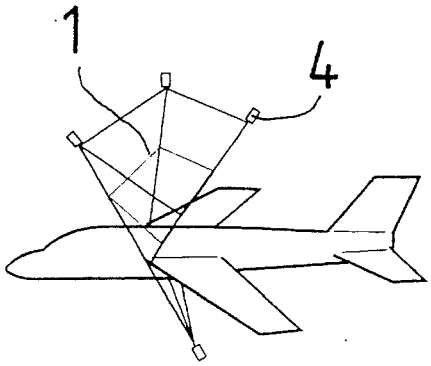
FIG. 2 shows the moment, at which the aircraft becomes entangled in the intercept device.

FIG. 2 shows the moment of the entanglement of the net-like intercept device 1 on the aircraft 2, whereby containers 4, in which aerodynamic resistance bodies are located, here in the form of small parachutes 5, are indicated. The deployment of these resistance bodies takes place automatically or by means of remote control, as a whole or selectively. A selective actuation, that is, staggered locally and with regard to time, is more favorable with regard to a limitation of the deceleration values of the aircraft, as well as to a specific effect on its aerodynamics. Thus, asymmetrical configurations, which force the aircraft into a curve or a descent, are also conceivable. There are countless possibilities with regard to the type and the actuation of the resistance bodies, e.g., balloons, air bags, parachutes, ribbons, foamed bodies, etc., whereby the actuation takes place most simply by means of the air current. However, pressurized gases, liquid foams, etc. may also be used.

Figure 3:
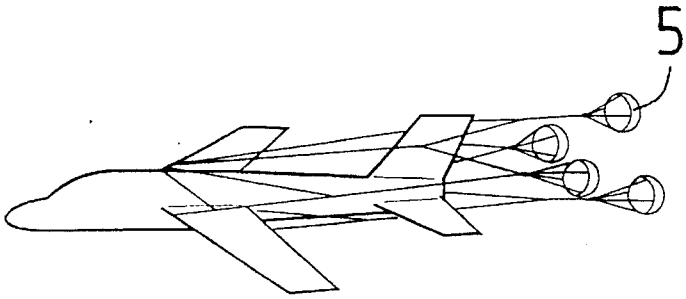
FIG. 3 shows the aircraft in the hindered state with deployed aerodynamic resistance bodies.

FIG. 3 shows the state of aerodynamic interference of the aircraft 2 with deployed parachutes 5. In this state, negotiations can be conducted with the crew or with its command post, and only if a termination of the mission has been assured, or a continuation is no longer sensible, the intercept device is destroyed, and the aircraft is released. Destruction may also be necessary as a result of the occurrence of dangerous flight conditions, such as being near the ground, nose dive, spinning, etc.

There are primarily two different methods and structural arrangements for the destruction of the intercept device.

A self-destruct device, which is activated by remote control, can be integrated into the intercept device. This self-destruct device may be, e.g., of a chemical, electromechanical, electromagnetic, electrothermal, or pyrotechnic nature. In this case, the structural material of the intercept device is preferably destroyed locally selectively by means of dissolving, melting, bursting, shredding, etc.

The intercept device can be destroyed by an outside influence, preferably by means of chemical reagents or high-energy beams. The former are launched, e.g., in the form of a fog or cloud, by means of an aircraft, missile, a grenade, or another carrier, in front of the aircraft in question, and they must be designed in such a manner that they attack the intercept device, but not the aircraft structure. High-energy beams are, for example, laser beams, which are directed at the intercept device from a suitable carrier or from the ground.

The methods of self-destruct and external destruction may also be combined. In the case of destruction, selective differentiation may be made between the release and the destruction of the resistance bodies and the destruction of the carrying structure, e.g., the net.

Figure 4:
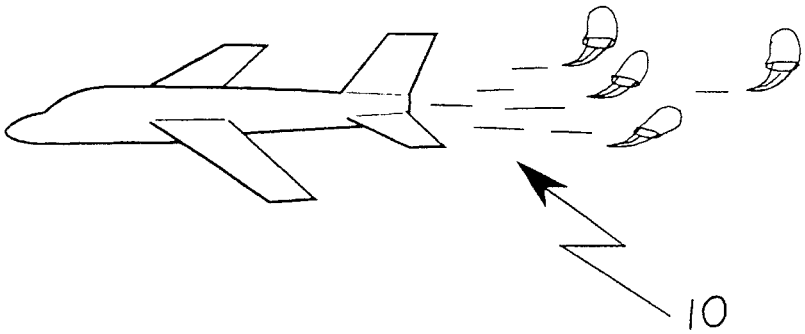
FIG. 4 shows the moment when the aircraft escapes from the destroyed intercept device.

Finally, FIG. 4 shows the moment when the aircraft 2 escapes from the destroyed intercept device 1, whereby the command signal 10 to destroy is indicated by a zigzagged arrow. For example, the command signal 10 may be in the form of a radio signal or other preferably wireless signalling where for example in the ease of the intercept termination means being in the form of a self destruct device, a container of chemicals for locally destroying part of the structure or a container of a pyrotechnic nature for locally destroying the structure, an electro thermal device or other structure for dissolving, melting, bursting, shredding or breaking the structure is controlled by a radio responsive control element, responsive to command signal 10. Upon issuance of the command signal 10, the self destruct device proceeds to break up the structure in a predefined way, thereby terminating the intercept procedure.

While specific embodiments of the invention have been shown and described in detail to illustrate the application of the principles of the invention, it will be understood that the invention may be embodied otherwise without departing from such principles.

What is claimed is:

1. An intercept device for flying objects, including manned aircraft, comprising:

a packable structure formed of a tear resistant, pliable material, the structure being stretchable to a large three dimensional expanded structure;

deployment means for deploying said structure by positioning said structure in the air, for intercepting a flying object, said structure changing from a packed state to an expanded state;

aerodynamic resistance bodies connected to said structure; and intercept termination means for locally destroying at least a portion of said structure adjacent to said aerodynamic resistance bodies for disconnecting said aerodynamic resistance bodies from the flying object without destroying the flying object whereby said structure is deployed in front of a flying object to intercept the flying object and said aerodynamic resistance bodies reduce the velocity of the intercepted flying object and said interception termination means destroys a portion of said structure to end interception of the flying object.

2. An intercept device according to claim 1, wherein said aerodynamic resistance bodies include activation means for activating said aerodynamic resistance bodies to change an amount of drag applied by said aerodynamic resistance bodies on said structure as said structure moves through the air with an intercepted flying object.

3. An intercept device according to claim 2, wherein said intercept termination means includes a self destruct element disposed on said structure for destroying a predetermined part of said structure said self destruct element including chemical reagents disposed adjacent to said structure, said chemical reagents being released by said activation means for at least partially dissolving a material forming said structure.

4. An intercept device according to claim 1, wherein said intercept termination means includes a self destruct element disposed on said structure for destroying a predetermined part of said structure.

5. An intercept device according to claim 4, wherein said self destruct element includes a receiving element for activating said self destruct element upon receiving a command signal.

6. An intercept device according to claim 4, wherein said self destruct device includes a pyrotechnic element connected to said structure for locally destroying said structure.

7. An intercept device according to claim 4, wherein said self destruct device includes fusible wire elements which locally break said structure.

8. An intercept device according to claim 4, wherein said self destruct device includes electro mechanical elements which locally break said structure.

9. An intercept device according to claim 1, wherein said structure is one of a net like structure, cobweb-like structure, balloon-like structure with a plurality of perforations and a hedge-hog like or dandelion-seed like structure including a plurality of ribbons, hoses and cables, which emanate from a center of said hedge-hog like or dandelion-seed like structure.

10. An intercept device according to claim 1, wherein said aerodynamic resistance body includes one of a balloon inflatable by air current, an inflatable air bag, a deployable parachute, ribbons which create drag upon rapid movement at abrupt angles and foam bodies including means for expanding said foam bodies.

11. An intercept device according to claim 10, wherein said means for expanding said foam bodies includes an element for filing said bodies with one of foam and an expanding agent.

12. An intercept device according to claim 1, wherein said intercept termination means includes forming said structure of a material that can be destroyed by one of a high energy beam and/or chemical reagent, deployed from outside of said structure.

13. A method for intercepting flying objects, including intercepting manned aircraft, comprising the steps of:

providing a structure formed of tear resistant, pliable material which can be stretched into a large three dimensional expanded structure;

packing said structure;

deploying said structure into the air, in front of a flying object using a deployment device;

providing aerodynamic resistance bodies which can be activated, the aerodynamic resistance bodies being connected to said structure;

intercepting a flying aircraft with said structure, in a deployed state and subsequently activating at least one of said aerodynamic resistance bodies to reduce a velocity of the intercepted flying object; and destroying at least a part of said structure to disconnect the aerodynamic resistance bodies and terminate interception of the flying body without destroying the flying object.

14. An intercept device for flying objects, including manned aircraft, comprising:

a light-weight, small volume packable structure formed of tear-resistant, pliable material, said structure being stretchable to a three dimensional expansion;

a deployment device for deploying said structure, said structure changing from a packed state to an expanded state upon completion of a deployment;

aerodynamic resistance bodies connected to said structure; and self destruct means for ending an intercept procedure including one of materials incorporated at one of said structure and said aerodynamic resistance bodies for locally destroying a portion of said one of said structure and said aerodynamic resistance bodies upon application of, said destruction means including one of high-energy beams and chemical reagents incorporated in one of said structure and said aerodynamic resistance bodies which can be activated for destroying a part of one of said structure and said aerodynamic resistance bodies.

15. An intercept device according to claim 14, wherein said structure is net-like including one of a cob web-like structure, balloon-like structure with a plurality of perforations, a hedge-hog-like structure, a dandelion-seed-like structure, a plurality of ribbons emanating from a center, a plurality of hoses emanating from a center and a plurality of cables emanating from a center.

16. An intercept device according to claim 14, wherein said aerodynamic resistance bodies comprised one of balloons inflatable by air current, air bags, deployable parachutes, ribbons that move rapidly at an abrupt angle and foamed bodies which may be expanded upon deployment.

17. An intercept device according to claim 14, wherein said self destruct means comprises said chemical reagents incorporated into said structure, said chemical reagents being releasable to dissolve a portion of said structure.

18. An intercept device according to claim 14, wherein said self destruct means includes pyrotechnic elements connected to said structure for locally destroying a portion of said structure.

19. An intercept device according to claim 14, wherein said self destruct means includes fusible wire elements which locally break a part of said structure.

20. An intercept device according to claim 14, wherein said self destruct means includes electrochemical elements connected to said structure for locally breaking a part of said structure.

* * * * *